United States Patent [19]

Thompson

[11] 4,025,077

[45] May 24, 1977

[54] GOLF SHAFT GRIPPING DEVICE

[76] Inventor: Homer T. Thompson, 1821 Muse, Fort Worth, Tex. 76112

[22] Filed: Jan. 26, 1976

[21] Appl. No.: 652,136

[52] U.S. Cl. ..... 273/166; 2/161 A

[51] Int. Cl.[2] ..... A63B 71/14

[58] Field of Search ..... 273/75, 81 R, 81 B, 273/81 D, 81.4, 165, 166, 54 B; 2/159, 161 R, 161 A, 16, 21

[56] References Cited

UNITED STATES PATENTS

| | | | |
|---|---|---|---|
| 1,483,595 | 2/1924 | Read | 2/161 A X |
| 1,997,364 | 4/1935 | Holden et al. | 273/165 |
| 2,079,261 | 5/1937 | Pardoe | 2/161 A X |
| 2,121,989 | 6/1938 | Schnase et al. | 273/81 B X |
| 2,302,875 | 11/1942 | Lykins | 273/166 X |
| 2,484,762 | 10/1949 | Strazza | 273/165 |
| 2,722,706 | 11/1955 | Chopp | 2/161 R X |
| 2,765,174 | 10/1956 | Strickler | 273/166 |
| 3,438,630 | 4/1969 | Petti | 2/161 A X |
| 3,728,736 | 4/1973 | Pugh | 2/21 |
| 3,875,591 | 4/1975 | Cantales | 273/166 X |
| 3,922,724 | 12/1975 | Shockovsky | 2/161 A |

FOREIGN PATENTS OR APPLICATIONS

| | | | |
|---|---|---|---|
| 322,512 | 12/1929 | United Kingdom | 273/166 |

*Primary Examiner*—Richard J. Apley
*Attorney, Agent, or Firm*—Arthur F. Zobal

[57] ABSTRACT

A device for allowing the thumb of a players hand to apply an increased amount of pressure to a golf shaft to prevent the shaft from twisting or turning in the course of a swing. The device comprises two wedge-shaped gripping portions secured to or coupled to the exterior of a flexible ring-shaped member adapted to be fitted around the thumb. In another embodiment, the wedge-shaped portions are coupled to the underside of the portion of a glove adapted to receive the thumb of a players hand.

5 Claims, 7 Drawing Figures

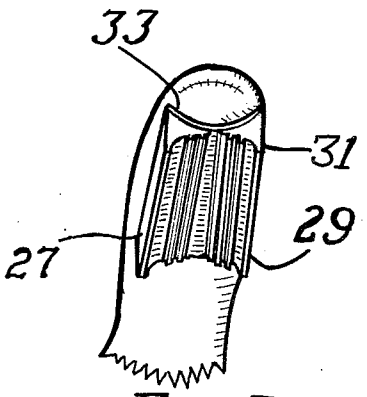
Fig. 7
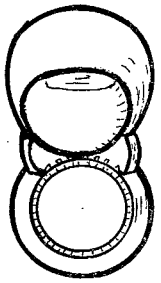
Fig. 5
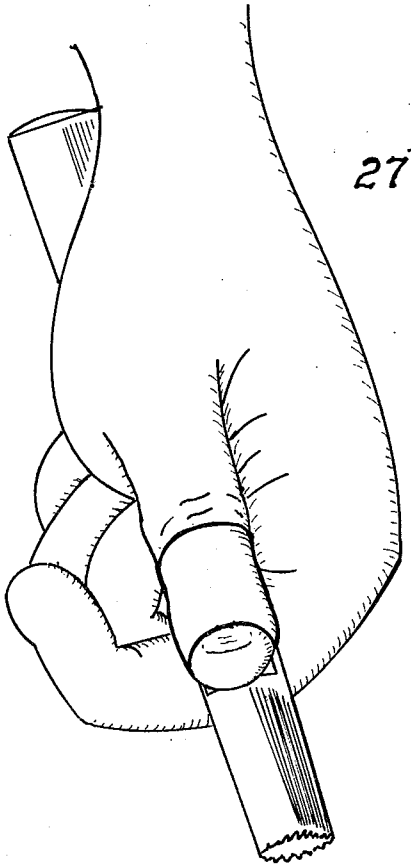
Fig. 4
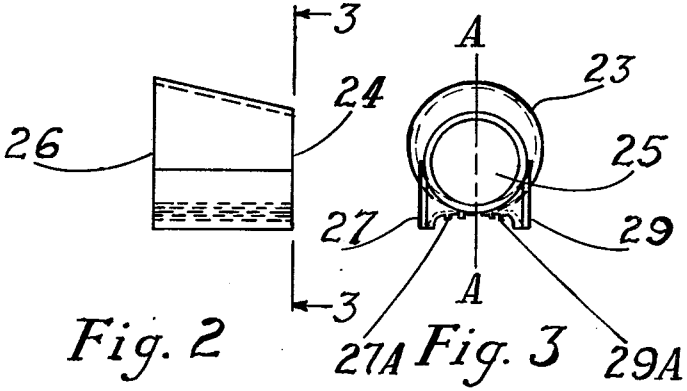
Fig. 2
Fig. 3
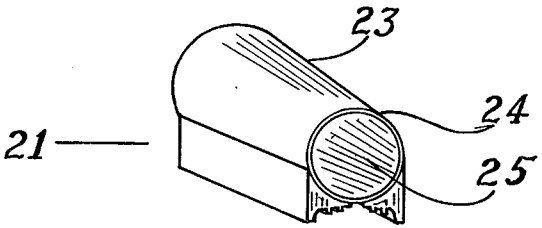
Fig. 1
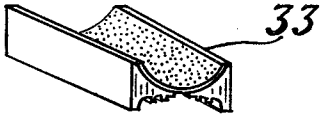
Fig. 6

GOLF SHAFT GRIPPING DEVICE

BACKGROUND OF THE INVENTION:

This invention relates to a device for use for preventing a golf shaft from twisting or turning about its axis during the course of a swing.

Many amateur golf players have problems in hitting the ball straight in that they lose their grip of the golf shaft during the course of the swing. This allows the shaft to turn or twist about its axis whereby the club face hits the ball at an angle different from that intended. Thus, the ball is projected or follows a path to the left or to the right of the desired direction.

SUMMARY OF THE INVENTION

It is an object of the present invention to provide a device for use for preventing a golf shaft from twisting or turning about its axis in the course of a swing by a player.

The device comprises flexible means having an opening for receiving the thumb of a players hand whereby said flexible means may be fitted around the thumb. The flexible means has a top side adapted to be located above the thumb and underside adapted to be located below the thumb when said flexible means is fitted around the thumb. Flexible gripping means is coupled to the exterior of said flexible means on its underside and comprises two wedge-shaped portions having gripping surface means adapted to engage a golf shaft to enable the thumb to increase the amount of pressure against the shaft to prevent the shaft from turning or twisting. The two wedge-shaped portions as seen in a first plane perpendicular to the axis of said opening taper toward a second plane perpendicular to said first plane and which second plane extends between said top and underside of said flexible means and bisects the opening of said flexible means.

In a further aspect, the two wedge-shaped portions comprise elongated ridges formed on the underside thereof and adapted to engage a golf shaft. The elongated ridges extend generally in the direction of the axis of said opening.

In one embodiment, said flexible means comprises a ring shaped member adapted to be fitted around the thumb. In another embodiment, said flexible means comprises the portion of a glove adapted to receive the thumb of a players hand.

BRIEF DESCRIPTION OF THE DRAWINGS:

FIG. 1 is a perspective view of the device of the present invention;

FIG. 2 is a side view of the device of FIG. 1;

FIG. 3 is an end view of the device of FIG. 1 as seen in the plane defined as 3—3 of FIG. 2;

FIG. 4 illustrates the device of FIGS. 1–3 fitted around the thumb of a players hand and engaging a golf shaft;

FIG. 5 is a view of FIG. 4 as seen in a plane perpendicular to the axis of the golf shaft;

FIG. 6 is another embodiment of the present invention;

FIG. 7 illustrates the device of FIG. 6 coupled to the underside of a portion of a glove of a players hand.

DETAILED DESCRIPTION OF THE INVENTION:

Referring now to FIGS. 1–5, the device of the present invention is indentified by reference numeral 21. It comprises a ring-shaped flexible member 23 having a central opening or aperture 25 formed therethrough for receiving the thumb of the players hand. Member 23 is tapered toward the front end 24 as shown for providing a proper fit around the thumb. The member 23 may be made out of rubber, suitable synthetic flexible rubber or plastic; leather; or other suitable flexible material. Secured to the bottom side of the member 23 are two flexible gripping members 27 and 29. As seen in FIG. 3, the two flexible gripping members 27 and 29 are wedge-shaped. They taper toward a plane A—A which extends between the top and underside of the member 23 and bisects the opening 25. At the junctions of the wedge-shaped members 27 and 29 with the member 23, the wedge-shaped members follow the arcuate contour of the member 23. The two wedge-shaped members 27 and 29 have elongated ridges 27A and 29A formed on their underside for gripping the golf shaft. These ridges extend generally in the direction of the axis of the opening 25 from the front end 24 to the rear end 26 of the member 23. The wedge-shaped members 27 and 29 preferably are formed of rubber or other suitable synthetic resilient material.

In using the device 21, it is fitted around the thumb of the player with the wedge-shaped members 27 and 29 located on the underside of the thumb as shown in FIG. 4. When the player grips the golf shaft, the thumb exerts a pressure which is applied to the top of the wedge-shaped members 27 and 29 which cause them to securely grip the golf shaft. Thus, in the course of a swing, the shaft is prevented from twisting or turning about its axis thereby allowing the player to hit the ball in the desired direction.

The wedge-shaped members 27 and 29 may be formed separately and bonded to the member 23 with suitable adhesive. As an alternative, if the member 23 and the wedge-shaped members 27 and 29 are formed of the same material, i.e. rubber or synthetic rubber or plastic, they may be molded with the wedge-shaped members 27 and 29 formed as an intergal part member 23.

In another embodiment, the wedge-shaped members 27 and 29 may be secured to the underside of the thumb section 31 of a players leather glove as shown in FIG. 7. In forming this embodiment, the wedge-shaped members 27 and 29 may be first secured to a flexible arcuate shaped member 33 as shown in FIG. 6. The arcuate member 33 may be secured to the underside of the flexible thumb section of the glove with suitable adhesive. The device of FIG. 6 may be formed by cutting off the top portion of the member 23 of FIG. 1. As an alternative, the device of FIG. 6 may be molded as one piece from rubber or suitable resilient synthetic material.

As a further embodiment, the wedge-shaped members 27 and 29 may be secured to or formed as an intergal part of a flexible and resilient member having an opening for receiving the thumb but having its front end closed similar to a thimble.

I claim:

1. A device for use for preventing a golf shaft from twisting about its axis in the course of a swing by a player, comprising:

flexible gripping means having a given length and width, said flexible gripping means comprising two wedge shaped portions extending along the length thereof, said wedge shaped portions as seen in a plane perpendicular to the length of said flexible gripping means, tapering generally toward the central portion of the width of said flexible gripping means such that said central portion has a thickness less than the thickness of the outer edges of said wedge shaped portions, said flexible gripping means having a top side adapted to be attached to the underside of the thumb section of a golf players glove with the length of said flexible gripping means extending along the length of the thumb section of the glove, said flexible gripping means having a bottom side defined in part by the bottom sides of said wedge shaped portions for engaging a golf shaft, the bottom sides of said wedge shaped portions as seen in a plane perpendicular to the length of said flexible gripping means, extending from the outer edges thereof upward toward said central portion such that said bottom side of said flexible gripping means may be fitted partially around a golf shaft.

2. The device of claim 1 comprising ridges formed on the bottom side of said flexible gripping means and which extend along the length thereof.

3. The device of claim 1 comprising a layer of adhesive deposited on the top side of said flexible gripping mens for attaching the top side thereof to the underside of the thumb section of a golf players glove.

4. The device of claim 2 comprising a layer of adhesive deposited on the top side of said flexible gripping means for attaching the top side thereof to the underside of the thumb section of a golf players glove.

5. The device of claim 3 comprising the combination therewith of a glove to be worn by a golf player, the top side of said flexible gripping means being attached, with said adhesive, to the underside of the thumb section of said glove such that the length of said flexible gripping means extends along the length of the thumb section of said glove.

* * * * *